US009271535B1

(12) United States Patent
Townsend

(10) Patent No.: US 9,271,535 B1
(45) Date of Patent: Mar. 1, 2016

(54) HAIR EXTENSION SEWING DEVICE

(71) Applicant: Yolunda Townsend, Chicago, IL (US)

(72) Inventor: Yolunda Townsend, Chicago, IL (US)

( * ) Notice: Subject to any disclaimer, the term of this patent is extended or adjusted under 35 U.S.C. 154(b) by 0 days.

(21) Appl. No.: 14/702,282

(22) Filed: May 1, 2015

(51) Int. Cl.
*D05B 97/02* (2006.01)
*A41G 5/00* (2006.01)
*D05B 97/08* (2006.01)

(52) U.S. Cl.
CPC ..... *A41G 5/0086* (2013.01); *D05B 97/02* (2013.01); *D05B 97/08* (2013.01)

(58) Field of Classification Search
CPC ..... A41G 5/0086; D05B 97/02; D05B 97/08
USPC ..... 112/169, 2, 104, 475.08
See application file for complete search history.

(56) References Cited

U.S. PATENT DOCUMENTS 2,594,534 A * 4/1952 Bell ..... D05B 81/00 112/169
2,639,683 A * 5/1953 Huntington ..... D05B 81/00 112/169
3,034,459 A * 5/1962 Shelley ..... B65B 51/07 112/10
3,745,950 A * 7/1973 Kato ..... D05B 73/00 112/169
D234,634 S * 3/1975 Doyel ..... 112/169
4,505,213 A * 3/1985 Killinger ..... D05B 27/04 112/169
5,651,322 A * 7/1997 Koike ..... D05B 73/00 112/169
5,669,318 A * 9/1997 Tsay ..... D05B 1/12 112/169
D392,293 S * 3/1998 Tsay ..... D15/69
6,973,931 B1 12/2005 King
7,036,518 B2 5/2006 Park
7,296,581 B2 11/2007 Gold
8,726,821 B2 * 5/2014 White ..... A41G 5/0053 112/169

* cited by examiner

*Primary Examiner* — Danny Worrell
(74) *Attorney, Agent, or Firm* — Crossley Patent Law

(57) ABSTRACT

A hair extension applicator including a base, an opening, a needle, a hook, a pair of curved hook extenders, a pair of grips, a concave thumb controller, an activation control, and a motor. The thumb controller has a selectively activated position. The hook is configured to create a loop in a thread when the thumb controller is in the activated position. The needle is configured to stitch the thread through a hair extension when the thumb controller is in the activated position. Each of the pair of hook extenders is configured to protect a user's head from injury.

6 Claims, 4 Drawing Sheets

HAIR EXTENSION SEWING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of hair extension devices are known in the prior art. However, what has been needed is a hair extension sewing device including a base, an opening, a needle, a hook, a pair of curved hook extenders, a pair of grips, a thumb controller, an activation control, and a motor. What has further been needed is for the thumb controller to have a selectively activated position. The thumb controller is in the activated position when a user applies a downward pressure to the thumb controller. Lastly, what has been needed is for the hook to be configured to create a loop in a thread when the thumb controller is in the activated position. The needle is also configured to stitch the thread through a hair extension when the thumb controller is in the activated position. The hair extension sewing device enables a user to avoid the time and effort that is required to sew in a hair extension by hand. Instead, a user can now quickly and efficiently utilize the hair extension sewing device to sew in hair extensions at home or in a salon.

FIELD OF THE INVENTION

The present invention relates to hair extension devices, and more particularly, to a hair extension sewing device.

SUMMARY OF THE INVENTION

The general purpose of the present hair extension sewing device, described subsequently in greater detail, is to provide a hair extension device which has many novel features that result in a hair extension sewing device which is not anticipated, rendered obvious, suggested, or even implied by prior art, either alone or in combination thereof.

To accomplish this, the present hair extension sewing device comprises a base. The base comprises an upper handle and a lower handle. Each of the upper handle and the lower handle has a front side, a back side, a top side, and a bottom side. The bottom side of the upper handle proximal the back side is hingedly attached to the top side of the lower handle proximal the back side. The base is optionally steel. An opening is continuously disposed between the bottom side of the upper handle and the top side of the lower handle from proximal the back side of each of the upper handle and the lower handle to the front side of each of the upper handle and the lower handle. A needle is disposed on the bottom side of the upper handle proximal the front side. A hook is continuously disposed through the lower handle from the front side of the lower handle to the top side of the lower handle. The hook has an upper edge and a lower edge. The upper edge of the hook is angularly disposed above the top side of the lower handle proximal the needle. The lower edge of the hook is disposed proximal the front side of the lower handle.

A pair of curved hook extenders comprises a top hook extender and a bottom hook extender. Each of the top hook extender and the bottom hook extender has a top surface and a bottom surface. The bottom surface of the top hook extender and the top surface of the bottom hook extender are collinearly disposed on the top side of the upper handle proximal the front side and the bottom side of the lower handle proximal the front side, respectively. A pair of grips comprises an upper grip and a lower grip. Each of the upper grip and the lower grip has a top edge and a bottom edge. The bottom edge of the upper grip is medially disposed on the top side of the upper handle. The top edge of the lower grip is medially disposed on the bottom side of the lower handle. The pair of grips is optionally rubberized.

A concave thumb controller is disposed on the top edge of the upper grip. The thumb controller is optionally rubberized. An activation control is disposed on the base. A motor is disposed within the base. A power connector is attached to the base and a power source. The thumb controller, the activation control, the motor, the power source, the hook, and the needle are in operational communication with each other. The thumb controller has a selectively activated position. The thumb controller is in the activated position when a user applies a downward pressure to the thumb controller. The hook is configured to create a loop in a thread when the thumb controller is in the activated position. The needle is configured to stitch the thread through a hair extension when the thumb controller is in the activated position. Each of the pair of hook extenders is configured to protect the user's head from injury.

The hair extension sewing device can optionally further comprise a C-shaped hanging hook. The hanging hook has a top end and a bottom end. The top end is disposed on the back side of the upper handle. The bottom end is disposed on the back side of the lower handle.

Thus has been broadly outlined the more important features of the present hair extension sewing device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 6 thereof, an example of the instant hair extension sewing device employing the principles and concepts of the present hair extension sewing device and generally designated by the reference number 10 will be described.

Figure 1:
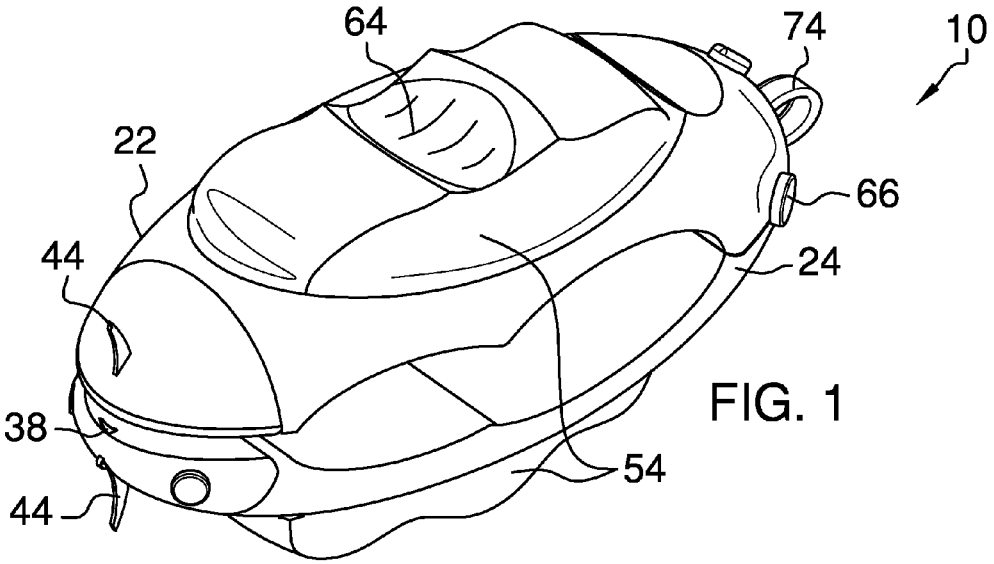
FIG. 1 is a front isometric view.
Figure 2:
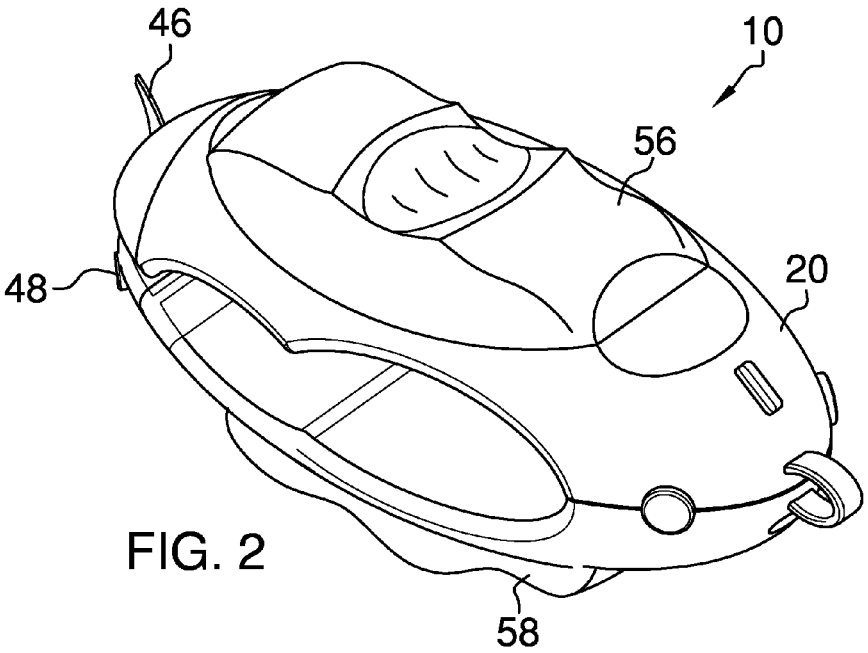
FIG. 2 is a back isometric view.
Figure 3:
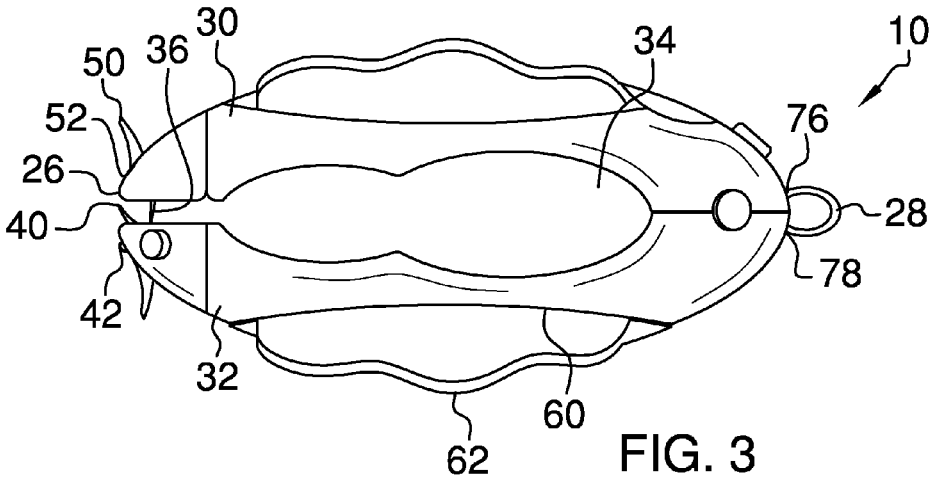
FIG. 3 is a side elevation view.
Figure 4:
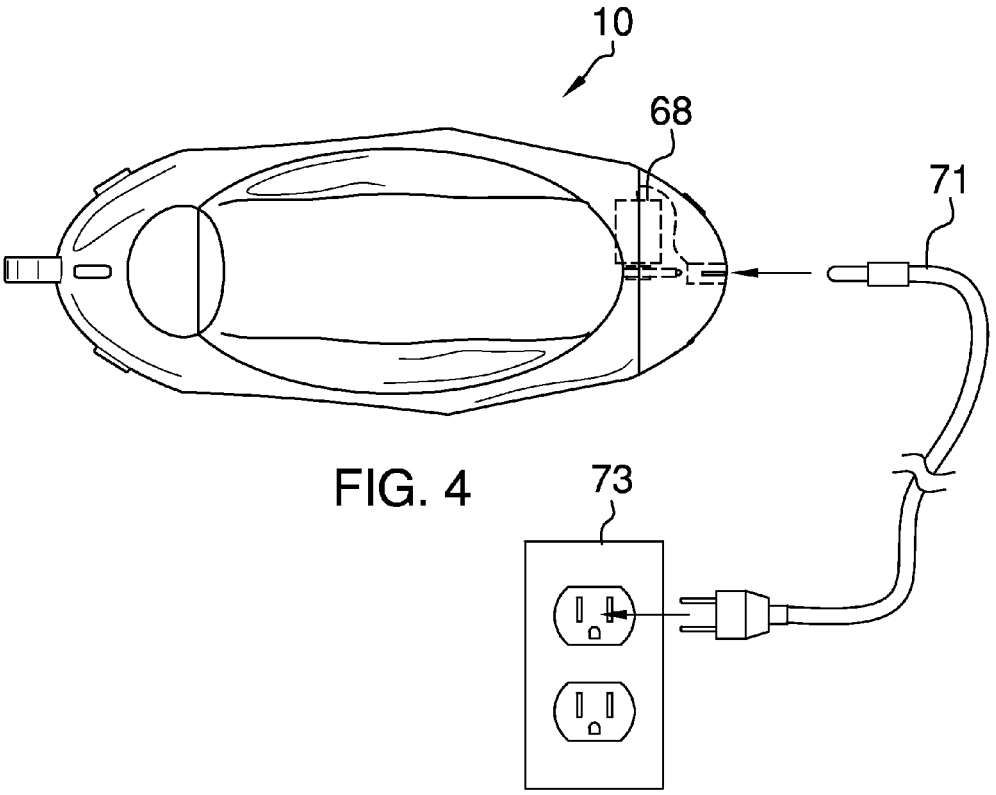
FIG. 4 is a bottom plan view.
Figure 5:
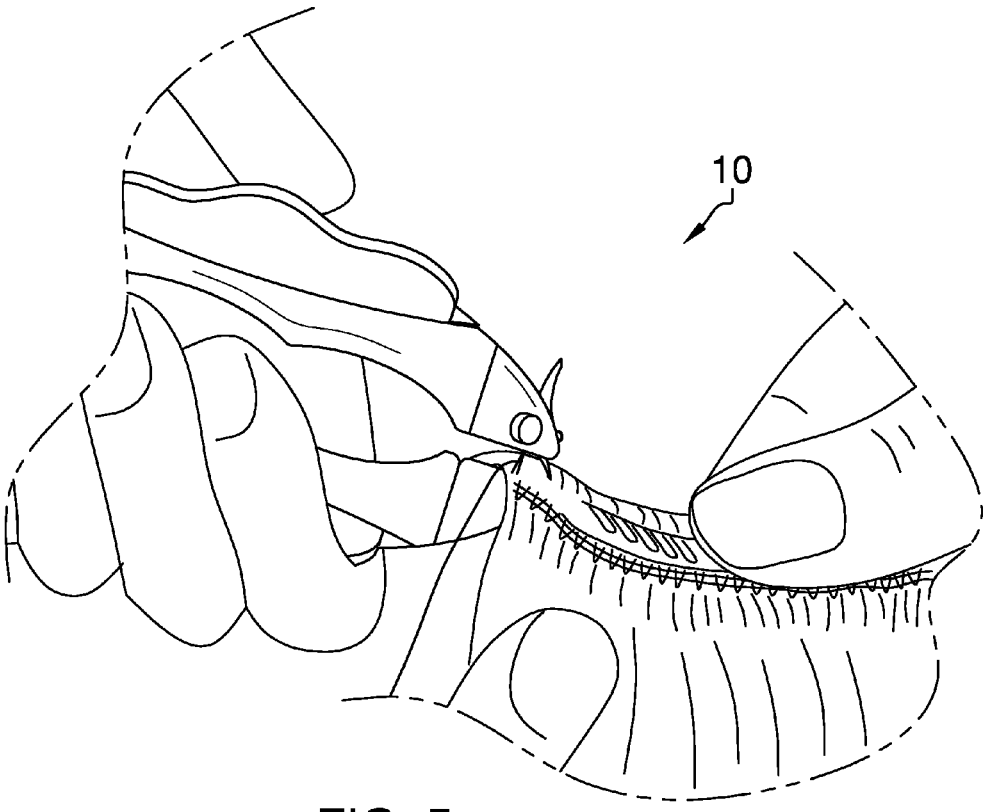
FIG. 5 is an in-use view.

Referring to FIGS. 1 through 6 the present hair extension sewing device 10 is illustrated. The hair extension sewing device 10 comprises a base 20. The base comprises an upper handle 22 and a lower handle 24. Each of the upper handle 22 and the lower handle 24 has a front side 26, a back side 28, a top side 30, and a bottom side 32. The bottom side 32 of the upper handle 22 proximal the back side 28 is hingedly attached to the top side 30 of the lower handle 24 proximal the back side 28. An opening 34 is continuously disposed between the bottom side 32 of the upper handle 22 and the top side 30 of the lower handle 24 from proximal the back side 28 of each of the upper handle 22 and the lower handle 24 to the front side 26 of each of the upper handle 22 and the lower handle 24. As best shown in FIG. 3, a needle 36 is disposed on the bottom side 32 of the upper handle 22 proximal the front side 26. A hook 38 is continuously disposed through the lower handle 24 from the front side 26 of the lower handle 24 to the top side 30 of the lower handle 24. As best shown in FIG. 3, the hook 38 has an upper edge 40 and a lower edge 42. The upper edge 40 of the hook 38 is angularly disposed above the top side 30 of the lower handle 24 proximal the needle 36. The lower edge 42 of the hook 38 is disposed proximal the front side 26 of the lower handle 24.

A pair of curved hook extenders 44 comprises a top hook extender 46 and a bottom hook extender 48. Each of the top hook extender 46 and the bottom hook extender 48 has a top surface 50 and a bottom surface 52. As best shown in FIG. 3, the bottom surface 52 of the top hook extender 46 and the top surface 50 of the bottom hook extender 48 are collinearly disposed on the top side 30 of the upper handle 22 proximal the front side 26 and the bottom side 32 of the lower handle 24 proximal the front side 26, respectively. A pair of grips 54 comprises an upper grip 56 and a lower grip 58. Each of the upper grip 56 and the lower grip 58 has a top edge 60 and a bottom edge 62. The bottom edge 62 of the upper grip 56 is medially disposed on the top side 30 of the upper handle 22. The top edge 60 of the lower grip 58 is medially disposed on the bottom side 32 of the lower handle 24.

Figure 6:
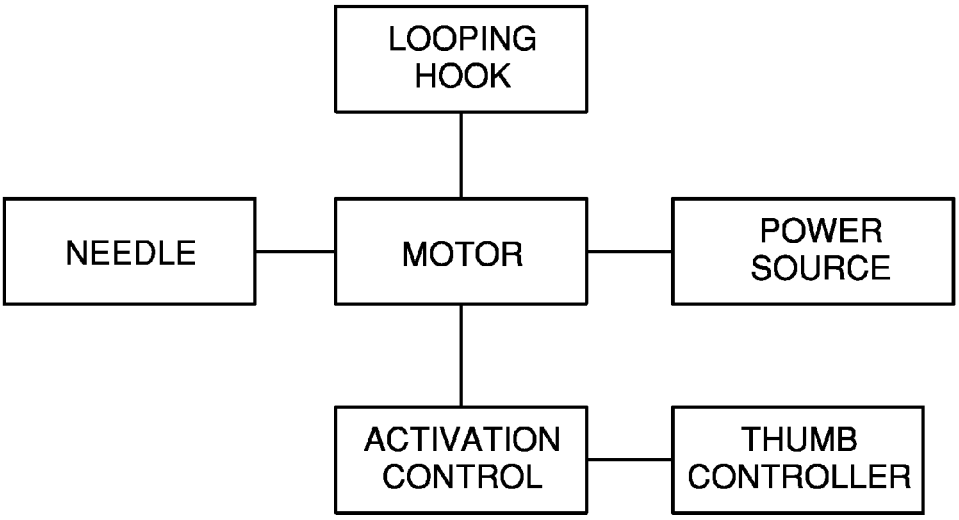
FIG. 6 is a block diagram showing a thumb controller, an activation control, a motor, a power source, a hook, and a needle in operational communication with each other.

A concave thumb controller 64 is disposed on the top edge 60 of the upper grip 56. An activation control 66 is disposed on the base 20. A motor 68 is disposed within the base 20. A power connector 71 is attached to the base 20 and a power source 73. As best shown in FIG. 6, the thumb controller 64, the activation control 66, the motor 68, the power source 72, the hook 38, and the needle 36 are in operational communication with each other.

The hair extension sewing device can optionally further comprise a C-shaped hanging hook 74. The hanging hook 74 has a top end 76 and a bottom end 78. The top end 76 is disposed on the back side 28 of the upper handle 22. The bottom end 78 disposed on the back side 28 of the lower handle 24.

What is claimed is:

1. A hair extension sewing device comprising:

a base comprising an upper handle and a lower handle, each of the upper handle and the lower handle having a front side, a back side, a top side, and a bottom side, the bottom side proximal the back side of the upper handle hingedly attached to the top side proximal the back side of the lower handle;

an opening continuously disposed between the upper handle bottom side and the lower handle top side from proximal the back side of each of the upper handle and the lower handle to the front side of each of the upper handle and the lower handle;

a needle disposed on the upper handle bottom side proximal the front side;

a hook continuously disposed through the lower handle from the lower handle front side to the lower handle top side, the hook having an upper edge and a lower edge, the hook upper edge angularly disposed above the lower handle top side proximal the needle, the hook lower edge disposed proximal the lower handle front side;

a pair of curved hook extenders comprising a top hook extender and a bottom hook extender, each of the top hook extender and the bottom hook extender having a top surface and a bottom surface, the top hook extender bottom surface and the bottom hook extender top surface collinearly disposed on the upper handle top side proximal the front side and the lower handle bottom side proximal the front side, respectively;

a pair of grips comprising an upper grip and a lower grip, each of the upper grip and the lower grip having a top edge and a bottom edge, the upper grip bottom edge medially disposed on the upper handle top side, the lower grip top edge medially disposed on the lower handle bottom side;

a concave thumb controller disposed on the upper grip top edge;

an activation control disposed on the base;

a motor disposed within the base; and a power connector attached to the base and a power source;

wherein the thumb controller, the activation control, the motor, the power source, the hook, and the needle are in operational communication with each other;

wherein the thumb controller has a selectively activated position;

wherein the thumb controller is in the activated position when a user applies a downward pressure to the thumb controller;

wherein the hook is configured to create a loop in a thread when the thumb controller is in the activated position;

wherein the needle is configured to stitch the thread through a hair extension when the thumb controller is in the activated position;

wherein each of the pair of hook extenders is configured to protect the user's head from injury.

2. The hair extension sewing device of claim 1 further comprising a C-shaped hanging hook having a top end and a bottom end, the top end disposed on the upper handle back side, the bottom end disposed on the lower handle back side.

3. The hair extension sewing device of claim 2 wherein the pair of grips is rubberized.

4. The hair extension sewing device of claim 3 wherein the thumb controller is rubberized.

5. The hair extension sewing device of claim 4 wherein the base is steel.

6. A hair extension sewing device comprising:

a base comprising an upper handle and a lower handle, each of the upper handle and the lower handle having a front side, a back side, a top side, and a bottom side, the bottom side proximal the back side of the upper handle hingedly attached to the top side proximal the back side of the lower handle;

wherein the base is steel;

an opening continuously disposed between the upper handle bottom side and the lower handle top side from proximal the back side of each of the upper handle and the lower handle to the front side of each of the upper handle and the lower handle;

a needle disposed on the upper handle bottom side proximal the front side;

a hook continuously disposed through the lower handle from the lower handle front side to the lower handle top side, the hook having an upper edge and a lower edge, the hook upper edge angularly disposed above the lower handle top side proximal the needle, the hook lower edge disposed proximal the lower handle front side;

a C-shaped hanging hook having a top end and a bottom end, the top end disposed on the upper handle back side, the bottom end disposed on the lower handle back side;

a pair of curved hook extenders comprising a top hook extender and a bottom hook extender, each of the top hook extender and the bottom hook extender having a top surface and a bottom surface, the top hook extender bottom surface and the bottom hook extender top surface collinearly disposed on the upper handle top side proximal the front side and the lower handle bottom side proximal the front side, respectively;

a pair of grips comprising an upper grip and a lower grip, each of the upper grip and the lower grip having a top edge and a bottom edge, the upper grip bottom edge medially disposed on the upper handle top side, the lower grip top edge medially disposed on the lower handle bottom side;

wherein the pair of grips is rubberized;

a concave thumb controller disposed on the upper grip top edge;

wherein the thumb controller is rubberized;

an activation control disposed on the base;

a motor disposed within the base; and a power connector attached to the base and a power source;

wherein the thumb controller, the activation control, the motor, the power connector, the hook, and the needle are in operational communication with each other;

wherein the thumb controller has a selectively activated position;

wherein the thumb controller is in the activated position when a user applies a downward pressure to the thumb controller;

wherein the hook is configured to create a loop in a thread when the thumb controller is in the activated position;

wherein the needle is configured to stitch the thread through a hair extension when the thumb controller is in the activated position;

wherein each of the pair of hook extenders is configured to protect the user's head from injury.

* * * * *